US007188463B2

(12) United States Patent
Schuller et al.

(10) Patent No.: US 7,188,463 B2
(45) Date of Patent: Mar. 13, 2007

(54) OPENING DEVICE FOR SPINNING MACHINES

(75) Inventors: Edmund Schuller, Ingolstadt (DE); Josef Schermer, Bergheim-Unterstall (DE); Mathias Burchert, Ostfildern (DE); Wilhelm Funk, Kreuzlingen (CH)

(73) Assignee: Rieter Ingolstadt Spinnereimaschinebau AG, Ingolstadt (DE)

( * ) Notice: Subject to any disclaimer, the term of this patent is extended or adjusted under 35 U.S.C. 154(b) by 21 days.

(21) Appl. No.: 11/154,266

(22) Filed: Jun. 16, 2005

(65) Prior Publication Data

US 2006/0026946 A1 Feb. 9, 2006

(30) Foreign Application Priority Data

Jun. 18, 2004 (DE) ..... 10 2004 029 659
Oct. 22, 2004 (DE) ..... 10 2004 051 676
Nov. 5, 2004 (DE) ..... 10 2004 053 427

(51) Int. Cl.
*D01H 4/32* (2006.01)

(52) U.S. Cl. ..... 57/408

(58) Field of Classification Search ..... 57/404–417
See application file for complete search history.

(56) References Cited

U.S. PATENT DOCUMENTS 4,358,922 A 11/1982 Feldstein
5,528,799 A 6/1996 Bach et al.
6,006,511 A 12/1999 Hofmann et al.
6,012,278 A 1/2000 Schermer
6,062,015 A * 5/2000 Schurmann et al. ..... 57/414
6,293,083 B1 9/2001 Schneider
6,475,565 B1 11/2002 Lukschandel et al.
6,866,619 B2 3/2005 Schermer
6,978,594 B2 * 12/2005 Schuller et al. ..... 57/408
2002/0124546 A1 9/2002 Schuller et al.
2004/0079069 A1 * 4/2004 Burchert ..... 57/408
2004/0137279 A1 7/2004 Richter et al.

FOREIGN PATENT DOCUMENTS

DE 4101680 7/1992
EP 0599286 B1 2/1997
WO 0052225 9/2000

OTHER PUBLICATIONS

German Patent Office Search Report, Dec. 7, 2004.
EPO Search Report, May 10, 2004.

* cited by examiner

*Primary Examiner*—Shaun R. Hurley
(74) *Attorney, Agent, or Firm*—Dority & Manning, PA

(57) ABSTRACT

The invention is relative to opening devices for spinning machines, especially open-end spinning machines, that are provided with clothing wires or rings for separating fibers of a supplied sliver. The opening device is characterized in that the clothing wires are pre-bent in accordance with the geometry of a carrier ring, or the clothing rings have the desired geometry of the finished part, and that the particular workpiece surfaces have an at least two-coating construction in which an outer coating is a hard-substance coating. The hard-substance coating consists entirely or partially of especially hard hard-substance components and rests on a substrate layer located underneath it.

37 Claims, 8 Drawing Sheets

OPENING DEVICE FOR SPINNING MACHINES

FIELD OF THE INVENTION

The present invention relates to an opening device for spinning machines, especially open-end spinning machines, that is provided with a clothing wire or opening ring for individualizing fibers of a supplied sliver. In addition, the invention relates to a method of producing such an opening device.

BACKGROUND

It is necessary in the manufacture of yarns in certain work steps to separate the fibers to be processed from each other, that is, to open their composition with each other. It is necessary, for example, in other manufacturing steps, to align fibers as parallel to each other as possible. This procedure is called parallelization. The fibers to be processed enter into a mechanical contact with the processing devices during opening as well as during the parallelization of the fibers. As a consequence of the mechanical contact, a mechanical wear occurs on the devices that is, on the one hand, disadvantageous for the service life of the devices and, on the other hand, for the quality of the produced products. Such wear phenomena are especially noticeable in opening devices of open-end spinning machines wherein the opening rollers rotate at speeds of a few thousand rotations per minute. The projection or "cam" elements fastened on their circumference strike the fibers to be individualized at a high speed and accelerate them, while sharply abrasive forces act on the corresponding structural parts of the devices. One possibility of designing the cam elements consists in providing an opening roller with a plurality of needle elements that separate fibers, e.g., from a sliver at every rotation and entrain them. Another technical solution provides designing the cams in the form of a working surface with sawteeth. In this instance, clothing wires in particular have proven themselves that consist of a long metal wire from which the saw-toothed contour is stamped out. The wire produced in this manner is then fastened to the opening roller with a helical groove. Another solution provides designing the opening rollers in one piece. In this instance saw-toothed geometries are formed into a single-piece workpiece, e.g., by turning and grinding.

The surface of the cams must therefore be as resistant as possible on account of the high mechanical wear. Moreover, there is the requirement of manufacturing such wear parts as economically as possible and therewith keeping the assembly cost as low as possible. Thus, e.g., especially hard surface coatings or top structures are known; however, they can either not be worked or can only be worked with great difficulty. Furthermore, the surface properties placed on the materials to be worked must be adapted, as result of which the use of certain surfaces that are easier to work is partially excluded.

SUMMARY

The present invention therefore has the problem of creating an opening device and a method of manufacturing it that permit an improved service life with an especially uniform quality of the products produced along with a simple working and that can also be coordinated particularly well with the products to be worked. Additional objects and advantages of the invention will be set forth in part in the following description, or may be obvious from the description, or may be learned through practice of the invention.

This problem is solved with an opening device characterized in that in particular the clothing wire is pre-bent in accordance with the geometry of a carrier ring and/or the ring has the desired geometry of the finished part. According to the invention, the particular workpiece surfaces have an at least two-layer construction in which an outer layer is a substance layer consisting entirely or partially of especially hard hard-substance components that rests on a substrate layer below it. As the shaping advantageously takes place prior to the application of the outer layer, even especially hard and brittle outer layers can be applied as required onto the wear-stressed surfaces of the opening devices that would otherwise frequently result in exfoliations in a subsequent shaping. Moreover, the qualities of the surface can be varied by varying the hard-substance components inside the outer layer. Thus, a higher amount of hard-substance component results in a surface that is especially resistant but also harder relative to the fibers to be processed and vice versa. In addition to the component, the type of the hard substances worked into the outer layer can be varied as required. This coordination can be adjusted in accordance with the needs of the user, especially the spinning technology requirements.

Outer layers have proved to be especially advantageous in this connection whose hardness is greater than 1500 HV [Vickers pyramid hardness], especially greater than 2000 HV. These hardness ranges have proven themselves in practical use and offer especially good service lives with an acceptable handling of the individual fibers at the same time. Even greater hardness values of 2500 HV and more can be achieved in the outer layer, if needed, with the present invention by a suitable selection of the hardness components and their handling.

It proved to be advantageous for the application of the outer layer to apply it using a CVD, PVD or plasma CVD method. All methods have the fact in common that they ensure an especially uniform layer thickness. Especially in the PVD and the plasma CVD methods, however, the application of the outer layer can take place at particularly low temperatures. This means that while the method is being carried out, only very slight changes are produced in the grain or texture structures of the substrate materials.

It proved to be especially advantageous for the composition of the outer layer if the hard-substance components of the outer layer selectively comprise one or several of the compounds CrN, CN, CrCN, TiN, TiTN, TiAIN, AlTiN, ZrN, NbN, WC or have the qualities of diamond-like carbon steel (DLC). Each of the compounds or materials cited can be used by itself or in combination with one or several of the others. Thus, their qualities can be combined with each other in an advantageous manner as required.

The application of the outer layer takes place in an advantageous embodiment of the invention in such a form that the outer layer is designed as a single-component layer. In the single-layer mode of application the outer layer can be applied, as already mentioned, with a freely selectable hard-substance component and/or one or several types of hard substances directly onto the substrate layer. As a result, the quantity and the quality of the outer layer containing hard substances can be especially well adapted to the particular requirements. It is possible in this embodiment already to adapt the wear resistance and the behavior of the material surface to the fibers to be processed by a suitable selection of the type and quantity of the hard-substance components used.

In another preferred embodiment of the invention, the outer layer is designed as a multilayer coating. The outer coating is built up in this instance from a plurality of layers. An alternating arrangement of relatively elastic coatings with especially resistant and hard coatings proved to be especially advantageous in this instance. The construction corresponds in this embodiment to a type of sandwich construction. The alternating arrangement of elastic and hard coatings has the advantage that, on the one hand, an especially resistant surface is created and at the same time the flexibility of the structural component is extensively retained by the elastic coatings. This substantially reduces the danger of exfoliations or other separations of the hard surface.

Another preferred embodiment of the invention provides that the outer coating contains dispersedly dissolved hard-substance particles with sizes in the nanometer range. So-called nanoparticles are permanently anchored in the outer coating on account of their especially small geometric dimensions and therefore do not separate out of the coating during operation. The particles can distinctly increase the wear resistance of the structural component on account of their hardness and are arranged at the same time in an elastic base body.

In order to improve the ability to resist wear, an advantageous embodiment of the invention provides that the outer coating is precipitation-hardened. Precipitation-hardening methods are already known in the state of the art; however, they offer a possibility in conjunction with the present invention of further improving the positive qualities of the devices in accordance with the invention. In particular, the outer coating can be designed to be even more wear-resistant after a precipitation hardening by the selection of suitable dispersedly dissolved hard-substance particles in ηm size.

Another advantageous embodiment of the invention provides that the substrate coating, in particular the surface of the wear-stressed sections of the opening device, is tempered prior to the application of the outer coating preferably at the application temperatures of the outer coating. A structural transformation possibly occurring during the application of the outer coating is already anticipated by the tempering. Therefore, the tempering preferably takes place at the same temperature that also prevails during the subsequent application of the outer coating. As already mentioned, the PVD method and the plasma CVD method offer the advantage in this connection of particularly low application temperatures.

Coating thicknesses of the outer coating between 2 and 8 μm proved to be especially advantageous. In this range, the applied outer coatings are capable on the one hand of protecting to a sufficient degree the substrate coatings located below them. At the same time, it is assured that the coating thicknesses are not so great that e.g., exfoliations or other separations occur.

An entirely different, advantageous embodiment of the invention provides that a carrier layer is applied between the outer coating and the substrate coating. This carrier layer or coating has two functions. The first function is to produce a reliable adhesion between'the substrate coating and the outer coating located above it. The second function of the carrier coating is based on the fact that it compensates rugosities and non-uniform areas in the substrate coating and thus creates an especially uniform bearing area or contact surface for the outer coating. An embodiment provides that the carrier coating is a coating applied by a chemical method. A carrier coating is advantageously used for this purpose that is a chemically applied nickel-phosphorus coating. Chemically applied coatings, especially of the previously cited type, have the advantage that they have extremely uniform coating thicknesses.

In order to achieve an especially protective handling of the fibers to be processed, it proved to be especially advantageous if the outer coating is deburred and/or polished. This can basically take place by means of all known deburring means and methods, but chemical and electrochemical deburring have proved to be especially suitable. The especially smooth surfaces of the clothing wires and/or rings worked in this manner handle the fibers to be processed in an extremely protective manner and consequently generate an especially low development of dust during the spinning process. In addition to deburring or instead of it, it is also suitable to polish the outer coating. This can take place, e.g., by a relative motion between the structural component designed in accordance with the invention and a polishing fluid. The polishing fluid conducts hard-substance particles that smooth the surface of the structural component by repeatedly striking it. Examples of hard-substance particles can be, e.g., diamond particles, corundum, silicon carbide or silicon nitride, that all have an especially high degree of hardness. If, for example, an opening device is allowed to rotate for a rather long time in such a polishing fluid, an especially smooth and resistant surface is obtained.

Another preferred embodiment of the invention provides that the carrier coating is a coating applied by a galvanic method. It proved to be especially advantageous in this instance if this coating is a galvanically applied nickel coating. Galvanically applied coatings are especially economical to manufacture and can be applied with a sufficient uniformity.

An entirely different embodiment of the invention advantageously provides that the carrier coating is an additional hard-substance coating. In contrast to the previously described outer coating with hard-substance components, this hard-substance coating designed as the carrier coating can be optimized, e.g., by a suitable selection of material as regards to a high degree of elasticity and an excellent coupling or adhesion characteristics.

The coating thickness of the carrier coating is advantageously between 3 and 10 μm and is therefore slightly thicker than the coating thickness of outer coating. In this instance, as the coating thickness of the carrier coating increases, its ability to compensate rugosities on the substrate coating grows.

Certain advantageous embodiments of the invention provide that the carrier coating is tempered at temperatures of 320° C. to 370° C., especially at 350° C. If, e.g., a chemical, applied nickel-phosphorus coating is used as carrier coating, a hardness of 900–100 HV can be achieved by such a tempering in the carrier coating. This is an especially resistant coating on which an outer coating applied to it finds on the one hand especially good adhesion and on the other hand an especially firm base.

In the method of the invention for manufacturing opening devices, the particular workpiece surfaces are provided with an at least two-coat construction in which an outer coating is applied onto a substrate coating underneath it, which outer coating is a hard-substance coating and consists entirely or partially of especially hard hard-substance components. The method furthermore suggested by the invention is characterized in that the clothing wire is advantageously pre-bent in accordance with the geometry of a carrier ring and/or that the opening ring is manufactured with the desired geometry of the finished part. Other advantageous embodiments of the invention result from the particular associated subclaims.

The invention is explained in detail in conjunction with the following exemplary embodiments and the drawings.

DESCRIPTION

Figure 1:
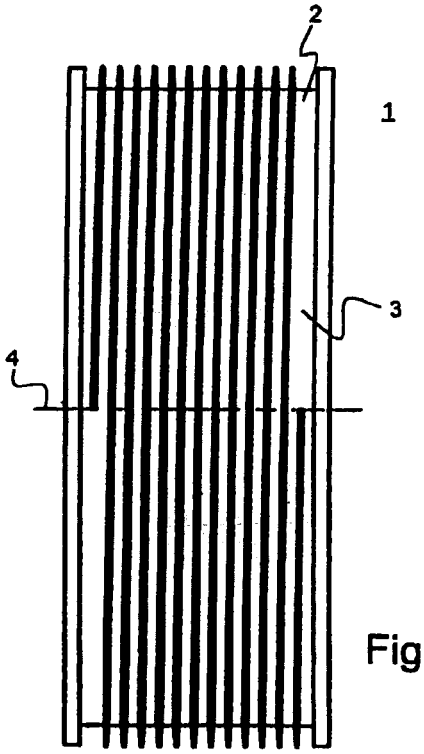
FIG. 1 shows a lateral view of an opening roller in accordance with the invention.

Reference is now made to embodiments of the invention, one or more of which are illustrated in the drawings. Each embodiment is provided by way of explanation of the invention, and not meant as a limitation of the invention. For example, features illustrated or described as part of one embodiment may be used with another embodiment to yield still a further embodiment. It is intended that the present invention include these and other modifications and variations.

FIG. 1 shows a lateral view of an opening roller 1 in accordance with the invention. Clothing wire 3 is arranged on carrier ring 2 on its radially outer side. This wire is arranged on carrier ring 2 with a plurality of windings and with a constant rise in the axial direction. Opening roller 1 in accordance with the invention rotates in the normal operating state with a high speed about axis of rotation 4. The fibers supplied in the radial direction to opening roller 1, e.g. in the form of a sliver, are grasped by the raised projections or "cam" elements of a working surface, such as wire 3, and are loosened out of the composition. As a consequence of the high speed and of the continuous operation, the cam elements are subjected to especially high mechanical wear.

Figure 2:
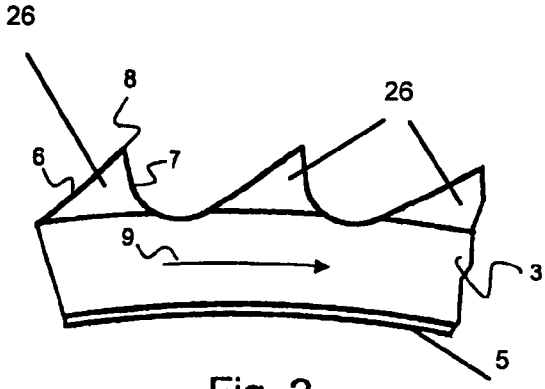
FIG. 2 shows a lateral view of the section of a garniture wire.

FIG. 2 shows a section of a clothing wire 3 in a lateral view. The wire 3 comprises foot area 5 serving for fastening to carrier ring 2. The use of foot profiles coordinated with grooves in carrier ring 2 have proven themselves well in practice for fastening the wire 3. The cam elements, that are designed in the present instance in the form of teeth 26, are located on the top of the wire 3. Teeth 26 comprise a rather flatly rising shank 6 on one side and on the opposite side a rather sharply falling shank 7. As a rule, a point 8 formed between the two shanks is inclined toward one side that imparts direction of rotation 9 to opening roller 1.

Figure 3:
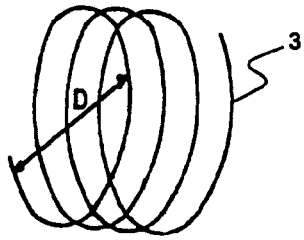
FIG. 3 shows a schematic view of a pre-bent garniture wire.

FIG. 3 schematically shows the helical winding of clothing wire 3, that is pre-bent with given diameter d. Diameter d corresponds either exactly or at least nearly to the outer diameter of carrier ring 2 or to the diameter of the groove bottom of the associated groove on carrier ring 2. As a consequence, pre-fabricated wire 3 no longer has to be subjected to any substantial deformations in order to be mounted on carrier ring 2. Therefore, coatings arranged on the surface of the wire 3 are hardly exposed to deformations any more during the mounting process.

Figure 4:
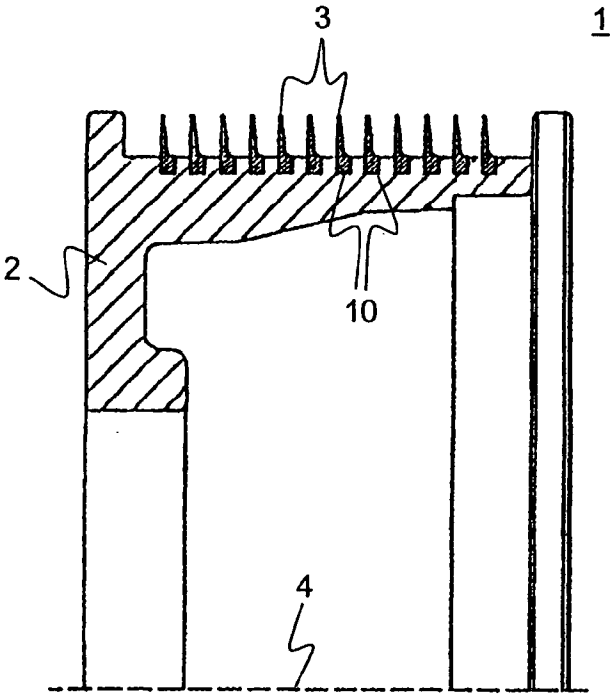
FIG. 4 shows a partial sectional view of an opening roller with garniture wire.

FIG. 4 shows one half of an opening roller 1 in accordance with the invention in an axial sectional view. The body of carrier ring 2 is characterized with a coarse hatching on the sheared edge. Spiral groove 10, in which clothing wire 3 characterized with a fine shading is inserted, is worked into carrier ring 2.

Figure 5:
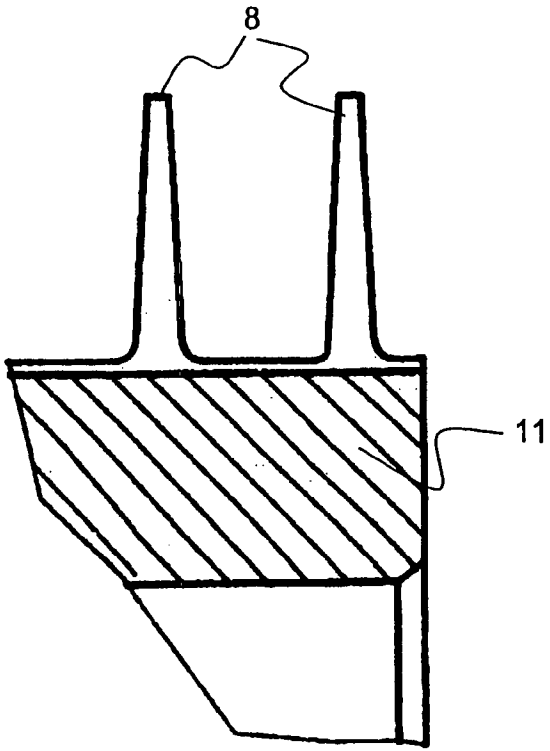
FIG. 5 shows a partial sectional view of a one-piece garniture ring.

FIG. 5 shows another possible embodiment of opening roller 1. In this instance, the opening roller has a working surface in the form of a clothing ring 11. In this embodiment, ring 11 with points 8 arranged on it is designed in one piece. The manufacture of such a ring 11 can take place, e.g., by machining work on a lathe followed by a subsequent working in of the tooth contours by grinding work in the direction transverse to the tooth webs previously manufactured by machining.

Figure 6:
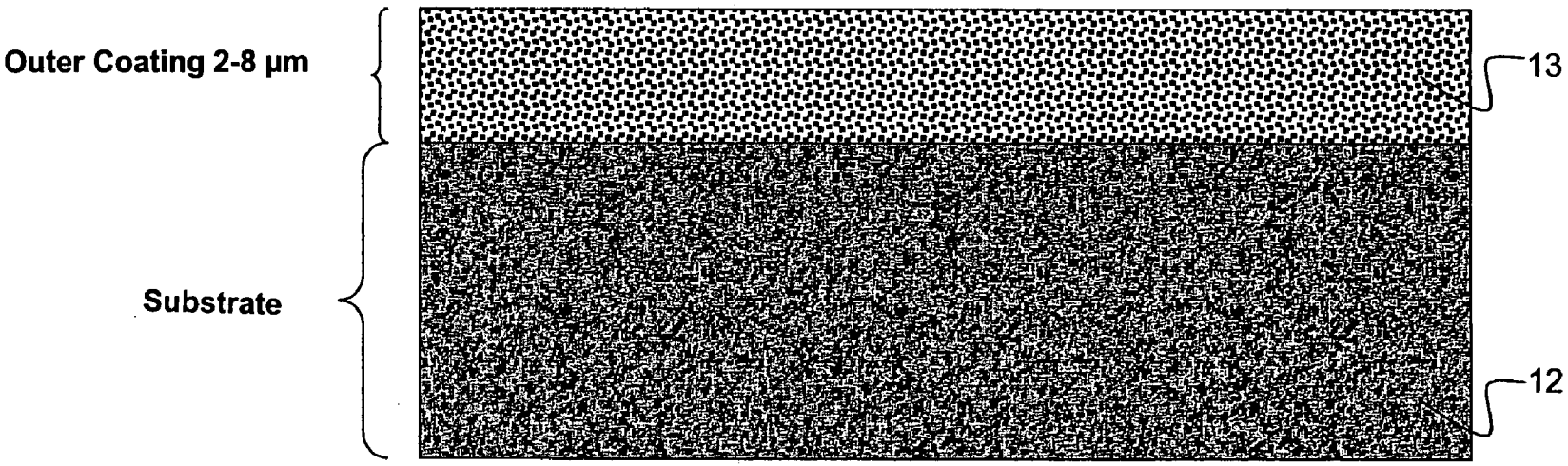
FIG. 6 shows a surface construction in accordance with the invention with a one-layer coating.

FIG. 6 shows a design in accordance with the invention of a first preferred embodiment of the invention. In this instance, the upper side is the outside of the workpiece and the lower side shows the area in the direction of the workpiece interior. The material of clothing wire 3 or of clothing ring 11, designated in the following as substrate 12, constitutes the lower substrate coating. Outer coating 13 is applied onto substrate 12, which outer coating preferably has a coating thickness of 2–8 μm. The application of an outer coating 13 takes place by means of a PVD, CVD or plasma CVD method. However, PVD and plasma CVD methods are preferably used since they can be carried out at distinctly lower coating temperatures than the CVD method. This avoids thermally caused structural changes in substrate 12 during the application of the coating. In order to improve the ability to retain the dimensions and shape of the workpiece to be manufactured, substrate 12 is subjected prior to the application of outer coating 13 to a tempering process. The temperature of the tempering preferably corresponds to the temperature at which outer coating 13 is applied. In this manner, the structural changes that otherwise occur during the application of outer coating 13 are anticipated. Outer coating 13 is formed as a single-layer coating in this embodiment. Hard-substance components are contained in this outer coating 13 that can be adapted both in their quality as well as in their quantity to the particular requirements. Examples of materials that can form hard-substance components are the already-described material and elements such as chromium, titanium, aluminum, zirconium, niobium, tungsten carbide compounds, etc., as well as materials with diamond-like properties and known under the designation DLC.

Figure 7:
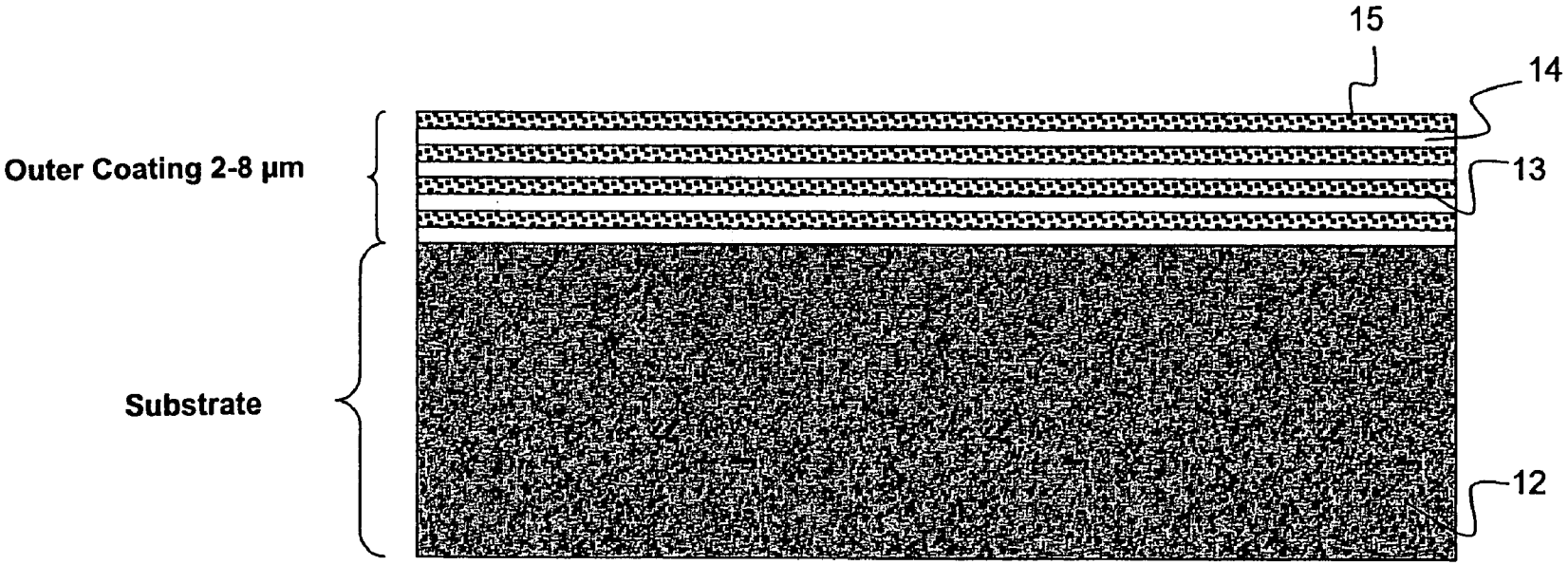
FIG. 7 shows a surface construction in accordance with the invention with a multi-layer coating.

FIG. 7 shows the schematic construction of the surface structure of another advantageous embodiment of the invention. Substrate 12 is again shown in the lower area, which has the same qualities as substrate 12 already described previously in FIG. 6. However, outer coating 13 located above it is constructed differently in this embodiment in as far as it is a multi-layer coating. The outer coating again has a coating thickness of preferably 2–8 μm. However, now two different materials are combined with one another in an alternating, superposed manner. This sandwich-like arrangement of coatings allows different types of materials and their advantageous qualities to be able to be combined with each other which at the same time makes it possible to use particularly elastic and particularly resistant materials in outer layer 13. Thus, for example, first coating 14 shown without shading can be a particularly elastic coating that unites a particularly resistant second coating 15 above it permanently to substrate 12 and the coatings under it. If a structural component built up in this manner is subjected to deformations the intrinsic tensions produced in hard coatings 15 are distinctly less than would be the case in a hard-substance layer extending homogeneously over the entire coating thickness. Consequently, exfoliations either do not occur at all or at least occur only under extreme conditions.

Figure 8:
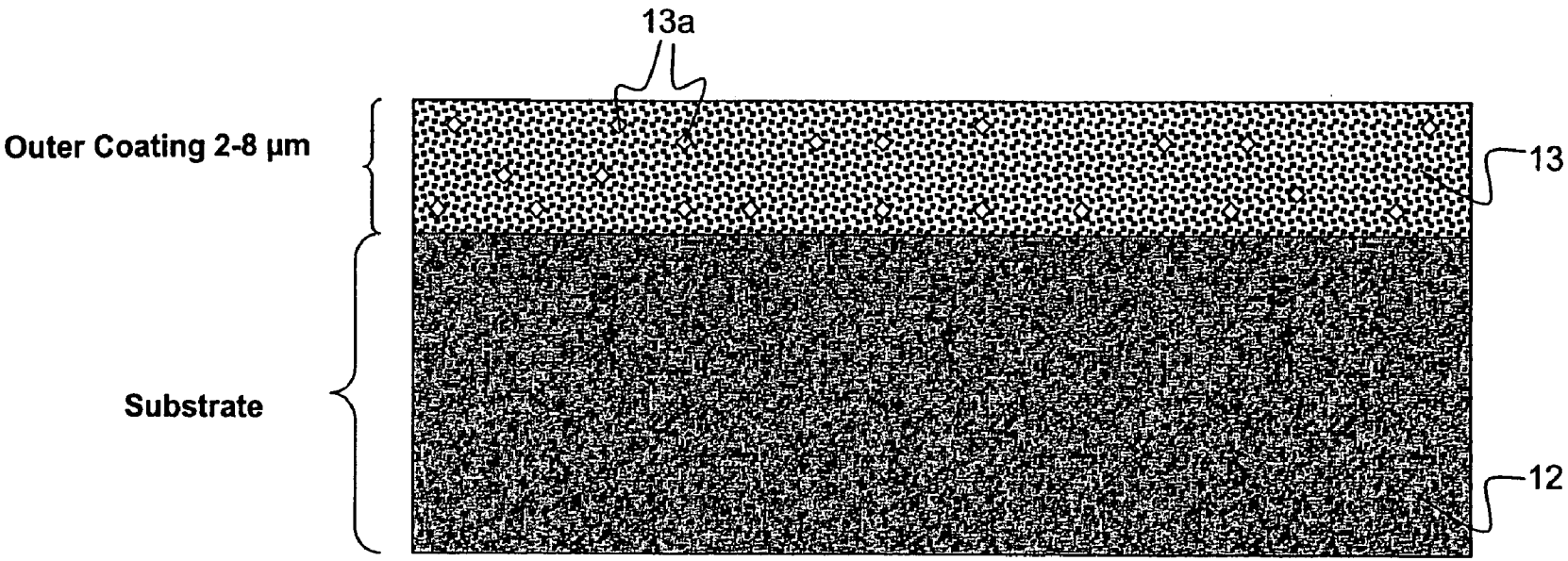
FIG. 8 shows a surface construction in accordance with the invention with dissolved hard-substance particles.

FIG. 8 shows another advantageous embodiment in which substrate 12 was again retained unchanged. Outer coating 13, however, contains dispersedly dissolved hard-substance particles 13*a* in nanometer size, applied on it. It is to be noted that the conditions of magnitude shown in FIG. 8, in particular those of hard-substance particles 13*a*, do not reflect the real magnitude scale. The incorporation of dissolved hard-substance particles 13*a* significantly increases the wear resistance of outer coating 13. In addition, there is the possibility of improving the outer coating in its ability to resist by an appropriate selection of the material of hard-substance particles 13*a* and a post-treatment as nanodisperse, precipitation-hardened coating. Even in this embodiment, the coating thickness of outer coating 13 was made in the range of 2–8 μm, so that the coating on the one hand offers sufficient wear reserves and at the same time no exfoliations occur on account of excessive intrinsic tensions.

Figure 9:
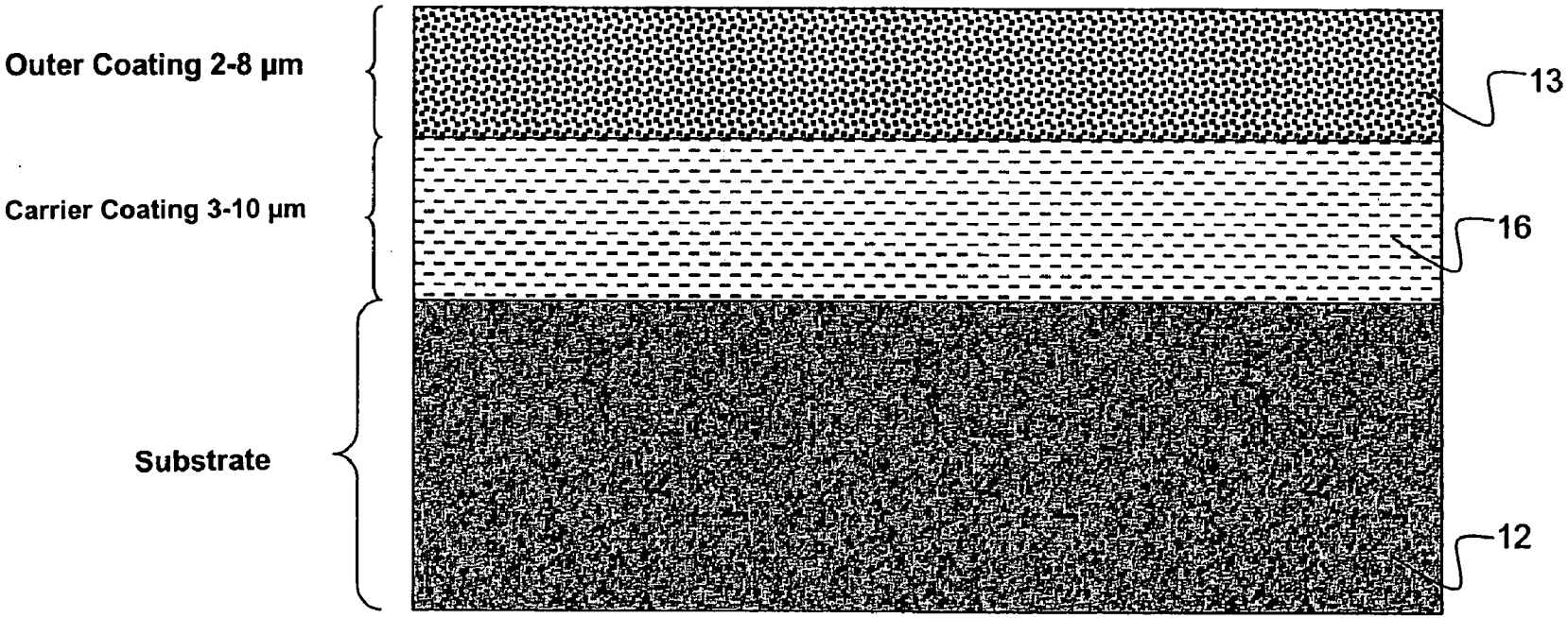
FIG. 9 shows a surface construction in accordance with the invention with an additional carrier coating.

FIG. 9 shows another advantageous embodiment of the invention in which an additional carrier coating 16 is arranged between outer coating 13 known from FIG. 6 and substrate 12 also known from this figure, which carrier coating 16 preferably has a coating thickness of 3–10 μm. Carrier coating 16 has two tasks. The first task is to improve the adhesion between outer coating 13 and substrate 12. The second task is to compensate rugosities present on the surface of substrate 12 and make an especially well-prepared bearing area available for outer coating 13. Carrier coating 16 is selectively applied with a chemical method or a galvanic method. A chemical nickel-phosphorus coating is especially suitable for the chemical method and a galvanic nickel coating for the galvanic method. The surface produced in this manner is especially clean and free of disturbances and, in addition, can be especially well reproduced in industrial use. Furthermore, an especially high degree of hardness can be achieved here already given appropriate carrier coatings. If a nickel-phosphorus coating is used as carrier coating its surface can achieve hardness values of approximately 1000 HV by tempering at preferably 350° C. This produces an especially advantageous foundation for outer coating 13 to be subsequently applied on it that is especially hard as well as level and in addition offers a good coupling.

Figure 10:
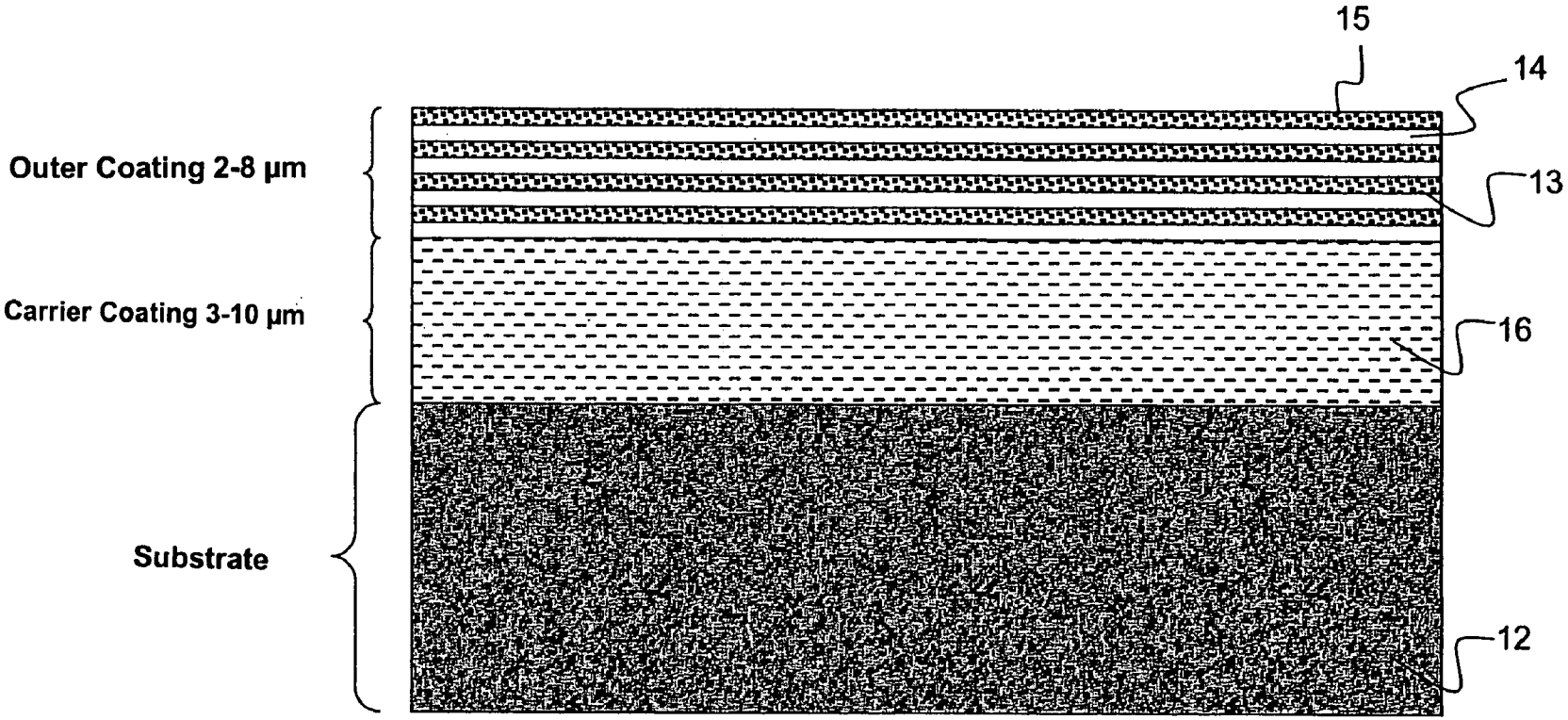
FIG. 10 shows a surface construction in accordance with the invention and with FIG. 7 with an additional carrier coating.
Figure 11:
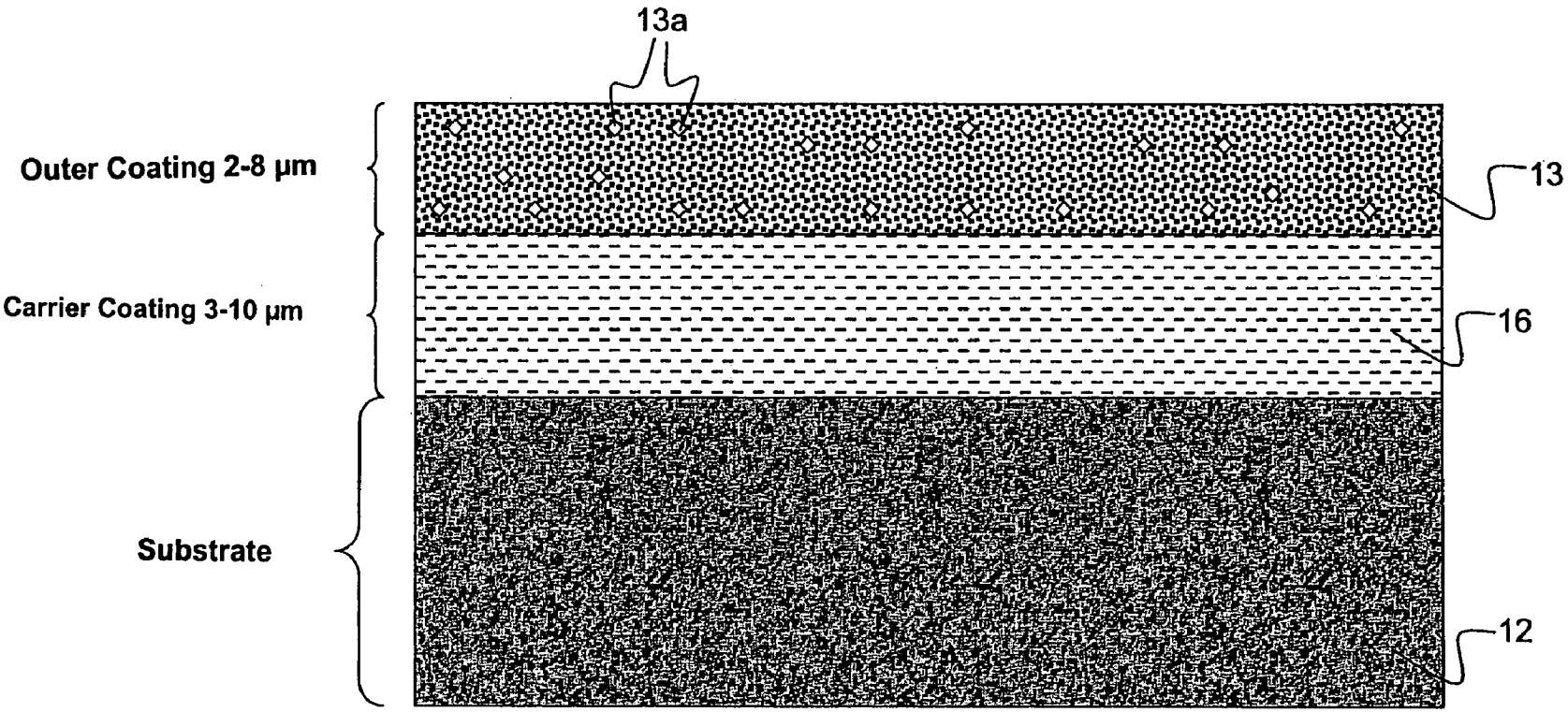
FIG. 11 shows a surface construction in accordance with the invention and with FIG. 8 with an additional carrier coating.

FIGS. 10 and 11 show substrate 12 and outer coating 13 again as they have already been described in FIGS. 7, 8. However, in distinction to the previous figures, carrier coatings 16 of the invention are arranged between outer coating 13 and substrate 12.

The present invention is not limited to the exemplary embodiment shown, but rather numerous variations of the invention are possible within the scope of the claims. Thus, e.g., instead of the hard-substance components cited in the subclaims other suitable materials and compounds with other properties can be used. Also, the coating constructions described for the opening device can be used on other wear-stressed structural components of textile machines such as, e.g., yarn draw-off nozzles or rotors. Furthermore, it is conceivable to mix the hard-substance components with other materials, to alloy them or to use them in a pure form.

The invention claimed is:

1. An opening device for opening fibers from a fiber sliver in a spinning machine, comprising a working surface having a plurality of individual projections extending radially therefrom that grasp and open individual fibers from the fiber sliver as said opening device rotates, said working surface further comprising an outer material layer formed at least partially of a hard-substance material, and a substrate material layer disposed beneath said outer layer, said outer layer formed around said substrate layer, and wherein said outer material layer comprises a multiple-layer coating.

2. The opening device as in claim 1, wherein said working surface comprises a clothing wire that is pre-bent into a spiral with a geometry corresponding to a carrier ring upon which said clothing wire is mounted.

3. The opening device as in claim 1, wherein said working surface comprises a clothing ring.

4. The opening device as in claim 1, wherein said outer material layer comprises a hardness value of at least 1500 HV.

5. The opening device as in claim 1, wherein said outer material layer is applied by one of a CVD, PVD, or plasma DVD coating method.

6. The opening device as in claim 1, wherein said hard-substance material is selected from the group consisting of: CrN, CN, CrCN, TiN, TiTn, TiAlN, AlTiN, ZrN, NbN, WC, and diamond carbon steel.

7. The opening device as in claim 1, wherein said multiple-layer coating of said outer material layer comprises at least a single layer of relatively elastic coating alternating with one layer of relatively resistant coating.

8. The opening device as in claim 1, wherein said outer multiple-layer coating includes at least one relatively elastic coating and at least two relatively resistant coatings, said relatively elastic coating being disposed between said at least two relatively resistant coatings.

9. The opening device as in claim 1, wherein said hard-substance material comprises dispersed nanometer range sized particles.

10. The opening device as in claim 1, wherein said outer material layer comprises a precipitation hardened material.

11. The opening device as in claim 1, wherein said substrate material layer comprises a material tempered at a temperature generally the same as an application temperature of said outer layer.

12. The opening device as in claim 1, wherein said outer material layer comprises a thickness within a range of about 2 to 8 microns.

13. The opening device as in claim 1, wherein said outer material layer comprises a deburred or polished surface.

14. The opening device as in claim 1, further comprising a carrier material layer disposed between said outer material layer and said substrate material layer.

15. The opening device as in claim 14, wherein said carrier material layer comprises a chemically applied coating.

16. The opening device as in claim 15, wherein said carrier material layer comprises a nickel-phosphorus coating.

17. The opening device as in claim 15, wherein said carrier material layer comprises a galvanic nickel coating.

18. The opening device as in claim 14, wherein said carrier material layer comprises a hard-substance material having a hardness value of at least about 900 HV.

19. The opening device as in claim 14, wherein said carrier material layer has a thickness within a range of about 3 to 10 microns.

20. The opening device as in claim 14, wherein said carrier material layer comprises a material tempered at a temperature of between about 320 to about 370 degrees Celsius.

21. A method of manufacturing a working surface component of an opening device for a spinning machine, the working surface having a plurality of individual projections extending radially therefrom that grasp and open individual fibers from a fiber sliver as the opening device rotates, said method comprising forming the working surface component with a substrate material layer and an outer material layer coated over the substrate material layer, the outer material layer formed at least partially of a hard-substance material, and wherein the outer material layer comprises a multiple-layer coating that is formed of at least one layer of relatively elastic coating disposed between the substrate material layer and one layer of relatively resistant coating.

22. The method as in claim 21, wherein the working surface component is a clothing wire, said method further comprising pre-bending the clothing wire into a spiral with a geometry corresponding to a carrier ring upon which the clothing wire is mounted.

23. The method as in claim 21, wherein the working surface component comprises a clothing ring.

24. The method as in claim 21, wherein the outer material layer comprises a hardness value of at least 1500 HV.

25. The method as in claim 21, wherein the outer material layer is applied by one of a CVD, PVD, or plasma DVD coating method.

26. The method as in claim 21, wherein the hard-substance material is selected from the group consisting of: CrN, CN, CrCN, TiN, TiTn, TiAlN, AlTiN, ZrN, NbN, WC, and diamond carbon steel.

27. The method as in claim 21, wherein the outer material said multiple layer coating of said outer material layer is applied by alternating at least two relatively elastic coatings and at least two relatively resistant coatings, at least one of said relatively resistant coatings being disposed between at least two said relatively elastic coatings.

28. The method as in claim 21, wherein the hard-substance material includes nanometer range sized particles dispersed in the material.

29. The method as in claim 21, further comprising precipitation hardening the outer material layer.

30. The method as in claim 21, further comprising tempering the substrate material layer at a temperature generally the same as an application temperature of the outer material layer.

31. The method as in claim 21, further comprising deburring or polishing the surface of the outer material layer by one of a chemical or electrochemical process.

32. The method as in claim 21, further comprising deburring or polishing the surface of the outer material layer with a polishing fluid that contains hard particles.

33. The method as in claim 21, further comprising forming a carrier material layer between the outer material layer and the substrate material layer by a chemical deposition or galvanic method.

34. The method as in claim 33, wherein the carrier material layer comprises a hard-substance material having a hardness value of at least about 900 HV.

35. The method as in claim 33, further comprising tempering the carrier material layer at a temperature of between about 320 to about 370 degrees Celsius.

36. A clothing wire for use with an opening device of a spinning machine, said clothing wire manufactured according to any one of the methods of claims 21, 22, and 24 through 35.

37. A clothing ring for use with an opening device of a spinning machine, said clothing ring manufactured according to any one of the methods of claims 21, and 23 through 35.

* * * * *

UNITED STATES PATENT AND TRADEMARK OFFICE

CERTIFICATE OF CORRECTION

PATENT NO. : 7,188,463 B2
APPLICATION NO. : 11/154266
DATED : March 13, 2007
INVENTOR(S) : Edmund Schuller et al.

It is certified that error appears in the above-identified patent and that said Letters Patent is hereby corrected as shown below:

Column 8, line 38 reads “wherein said outer multiple-layer” should read -- wherein said multiple-layer --

Column 9, line 40 reads “claim 21, wherein the outer material said multiple” should read -- claim 21, wherein said multiple --

Signed and Sealed this

Fifteenth Day of April, 2008

JON W. DUDAS
*Director of the United States Patent and Trademark Office*